US010731936B1

(12) United States Patent
Sapio et al.

(10) Patent No.: US 10,731,936 B1
(45) Date of Patent: Aug. 4, 2020

(54) MODULAR GRIP PANEL SYSTEM FOR A FIREARM

(71) Applicant: Kimber IP, LLC, Yonkers, NY (US)

(72) Inventors: Daniel Edward Sapio, Bronxville, NY (US); Lucio Ditrolio, Mineola, NY (US); Ronald Richard Dudzic, Jr., Tarrytown, NY (US); Kevin Johnsrud, Morrisville, PA (US)

(73) Assignee: Kimber IP, LLC, Yonkers, NY (US)

( * ) Notice: Subject to any disclaimer, the term of this patent is extended or adjusted under 35 U.S.C. 154(b) by 0 days.

(21) Appl. No.: 16/358,149

(22) Filed: Mar. 19, 2019

(51) Int. Cl.
*F41A 11/00* (2006.01)
*F41C 23/10* (2006.01)

(52) U.S. Cl.
CPC ..... *F41A 11/00* (2013.01); *F41C 23/10* (2013.01)

(58) Field of Classification Search
CPC ..... F41A 11/00; F41C 23/10
See application file for complete search history.

(56) References Cited

U.S. PATENT DOCUMENTS 984,519 A 2/1911 Browning
1,228,506 A * 6/1917 Wesson ..... F41C 23/10 42/71.02
1,531,796 A * 3/1925 Loomis ..... F41C 23/10 42/71.02
2,034,632 A * 3/1936 Rice ..... F41C 23/10 42/71.02
2,081,438 A * 5/1937 Pomeroy ..... F41C 23/10 42/71.02
2,308,627 A * 1/1943 Rickenbacher ..... F41C 23/10 42/71.02
4,276,709 A * 7/1981 Bross ..... F41C 23/10 42/71.02
4,315,379 A * 2/1982 Lang ..... F41C 23/10 42/71.02
4,586,282 A * 5/1986 Sniezak ..... F41C 23/10 42/71.02
4,625,445 A * 12/1986 Ruger ..... F41C 23/10 42/71.02
4,771,562 A * 9/1988 Ruger ..... F41C 23/10 42/71.02
4,999,941 A * 3/1991 Farrar ..... F41C 23/10 42/71.02
5,231,237 A * 7/1993 Cupp ..... F41C 23/10 42/71.02

(Continued)

*Primary Examiner* — Michelle Clement
(74) *Attorney, Agent, or Firm* — Kaplan Breyer Schwarz, LLP

(57) ABSTRACT

A modular grip panel system for a firearm has a frame to support a pair of grip panels and a backstrap. The system includes a left and right grip panels having pockets, and a backstrap having a boss. The frame has a grip disposed at its rear end having a left and right side bosses to engage the pockets of the grip panels, and a rear surface pocket to receive the backstrap boss. The grip panels are disposed on the side surfaces of the pistol-style grip by insertion of the bosses into the pockets. The backstrap is disposed on the rear surface of grip by insertion of the backstrap boss into the rear surface pocket. When the backstrap is secured to the frame, the boss of grip panels are held in a forwardmost position. The backstrap prevents movement of the left and right grip panels towards the rear end of the frame.

8 Claims, 7 Drawing Sheets

(56) References Cited

U.S. PATENT DOCUMENTS

| | | | | |
|---|---|---|---|---|
| 5,621,997 | A * | 4/1997 | Pearce | F41C 23/10 42/7 |
| 6,112,446 | A * | 9/2000 | Forster | F41C 23/10 42/71.02 |
| 7,937,874 | B2 * | 5/2011 | Roth | F41C 23/10 42/7 |
| 8,156,677 | B2 * | 4/2012 | Glock | F41A 11/02 42/71.01 |
| 8,561,338 | B2 * | 10/2013 | Chvala | F41C 23/08 16/430 |
| 8,584,390 | B1 * | 11/2013 | Fraher | F41C 23/10 42/71.02 |
| 9,303,936 | B2 * | 4/2016 | Toner | F41A 17/62 |
| 2004/0049963 | A1 * | 3/2004 | Christiansen | F41C 23/10 42/71.02 |
| 2005/0268515 | A1 * | 12/2005 | Key-Carniak | F41C 23/10 42/71.02 |
| 2006/0096147 | A1 * | 5/2006 | Gussalli Beretta | F41C 23/10 42/71.02 |
| 2008/0060247 | A1 * | 3/2008 | Thomele | F41A 3/66 42/71.02 |
| 2010/0263254 | A1 * | 10/2010 | Glock | F41A 11/02 42/71.02 |
| 2011/0162248 | A1 * | 7/2011 | Trpcic | F41A 17/56 42/108 |
| 2013/0139426 | A1 * | 6/2013 | Baxley | F41C 23/10 42/71.02 |
| 2013/0205635 | A1 * | 8/2013 | Hines | F41C 23/16 42/71.02 |
| 2015/0192386 | A1 * | 7/2015 | Hines | F41C 23/16 42/71.02 |

* cited by examiner

MODULAR GRIP PANEL SYSTEM FOR A FIREARM

BACKGROUND OF THE INVENTION

This invention is directed to firearm grips. More particularly, this invention is directed to firearm handgun-style grips that are removable and replaceable.

Grips for firearms such as handguns and other pistols have been in use essentially since firearms were invented. Firearms having removable and therefore interchangeable grips have also likely been available for nearly as long. See, for example, the patent for the original 1911-style pistol (U.S. Pat. No. 984,519 (Browning) which shows the commonly seen screw-on style grips where separate grip panels are secured to the pistol frame by a pairs of screws visible on the outer surfaces of the grip panels.

However, in many circumstances, it would be desirable to eliminate the visible and often unsightly screw heads or other external fasteners used to secure the grip panels to the frame for handguns and other firearms. Such a design would offer improved aesthetics for firearms, and provide for interchangeability of grips to, for example, reduce or increase grip thickness and/or overall firearm width, allow a user to purchase alternative grip options either from the original handgun manufacturer, or the aftermarket, to obtain desired grip color, texture, profile, material, and the like.

All references cited herein are incorporated herein by reference in their entireties.

BRIEF SUMMARY OF THE INVENTION

Grip panels utilize a dovetail design whereby the leading-edge dovetail mortise on the frame is fixed and the rear dovetail mortise is spring loaded and shared across the frame with the opposite side grip panel. The rear dovetail mortise engages the left and right grip panels as the backstrap is inserted into the frame. The backstrap interlocks with the frame to provide retention and compress the rear dovetail mortise. A single retention feature is then used to lock the backstrap in place. Grip panels incorporate a boss and pocket system dampened by O-rings.

In the present invention, a modular grip panel system for a firearm is provided. The firearm has a frame to support a pair of grip panels and a grip backstrap. The system includes a left grip panel having an outer surface and an inner surface, the inner surface having a left side pocket and a right grip panel having an outer surface and an inner surface, the inner surface having a right side pocket. A backstrap has an outer surface and an inner surface, where the inner surface has a backstrap boss. The frame has a barrel end and a rear end and a pistol-style grip disposed at the rear end. The pistol-style grip includes a left side surface having a left side boss to engage the pocket of the left grip panel, a right side surface generally being a mirror image of the left side surface and having a right side boss to engage the pocket of the right grip panel, a rear surface having a rear surface pocket to receive the backstrap boss, and a bottom surface.

The left grip is panel disposed on the left side surface of the pistol-style grip of the frame by insertion of the left side boss into the left side pocket. The left grip panel is capable of limited movement in a single degree of freedom along an axis from the barrel end and the rear end of the frame. The right grip panel is disposed on the right side surface of pistol-style grip of the frame by insertion of the right side boss into the right side pocket. The right grip panel is capable of limited movement in a single degree of freedom along the axis from the barrel end and the rear end of the frame. The backstrap is disposed on the rear surface of the pistol-style grip of the frame by insertion of the backstrap boss into the rear surface pocket.

When the backstrap is secured to the frame, the left grip panel is held in a forwardmost position to secure the left grip panel to the frame, and the right grip panel is held in a forwardmost position to secure the right grip panel to the frame. When secured, the backstrap prevents movement of the left and right grip panels towards the rear end of the frame.

A front edge of the left side pocket of the frame includes a dovetail feature to mate with a dovetail feature adjacent a front edge on the inner surface of the left grip panel. When the left grip panel is in the forwardmost position, the dovetail features mate to secure the left grip panel to the frame. A front edge of the right side pocket of the frame includes a dovetail feature to mate with a dovetail feature adjacent a front edge on the inner surface of the right grip panel. When the right grip panel is in the forwardmost position, the dovetail features mate to secure the left grip panel to the frame.

The system may include a rear dovetail mortise member disposed in a slot adjacent to the rear pocket of the frame that is capable of movement in the slot in a single degree of freedom along an axis generally from the barrel end and the rear end of the frame. When the mortise member is disposed in a forwardmost position in the slot, the dovetail feature of the left, grip panel mates with the dovetail feature of the left side pocket to secure the left grip panel to the frame, and the dovetail feature of the right grip panel mates with the dovetail feature in the right side pocket to secure the right grip panel to the frame.

The backstrap may be secured in the frame via a set screw disposed in a threaded hole in the bottom surface of the frame to pin the backstrap to the frame.

The mortise member may be biased toward the barrel end of the frame, by, for example, a spring. The right side boss of the frame and the left side boss of the frame may each have an O-ring disposed thereon to minimize movement of the right grip panel and the left grip panel relative to the frame. Finally, the backstrap may lock into the frame with a double key-hole feature to prevent movement of backstrap relative to the frame to a single degree of freedom for installation and removal of the backstrap.

BRIEF DESCRIPTION OF SEVERAL VIEWS OF THE DRAWINGS

The invention will be described in conjunction with the following drawings in which like reference numerals designate like elements and wherein.

Figure 1:
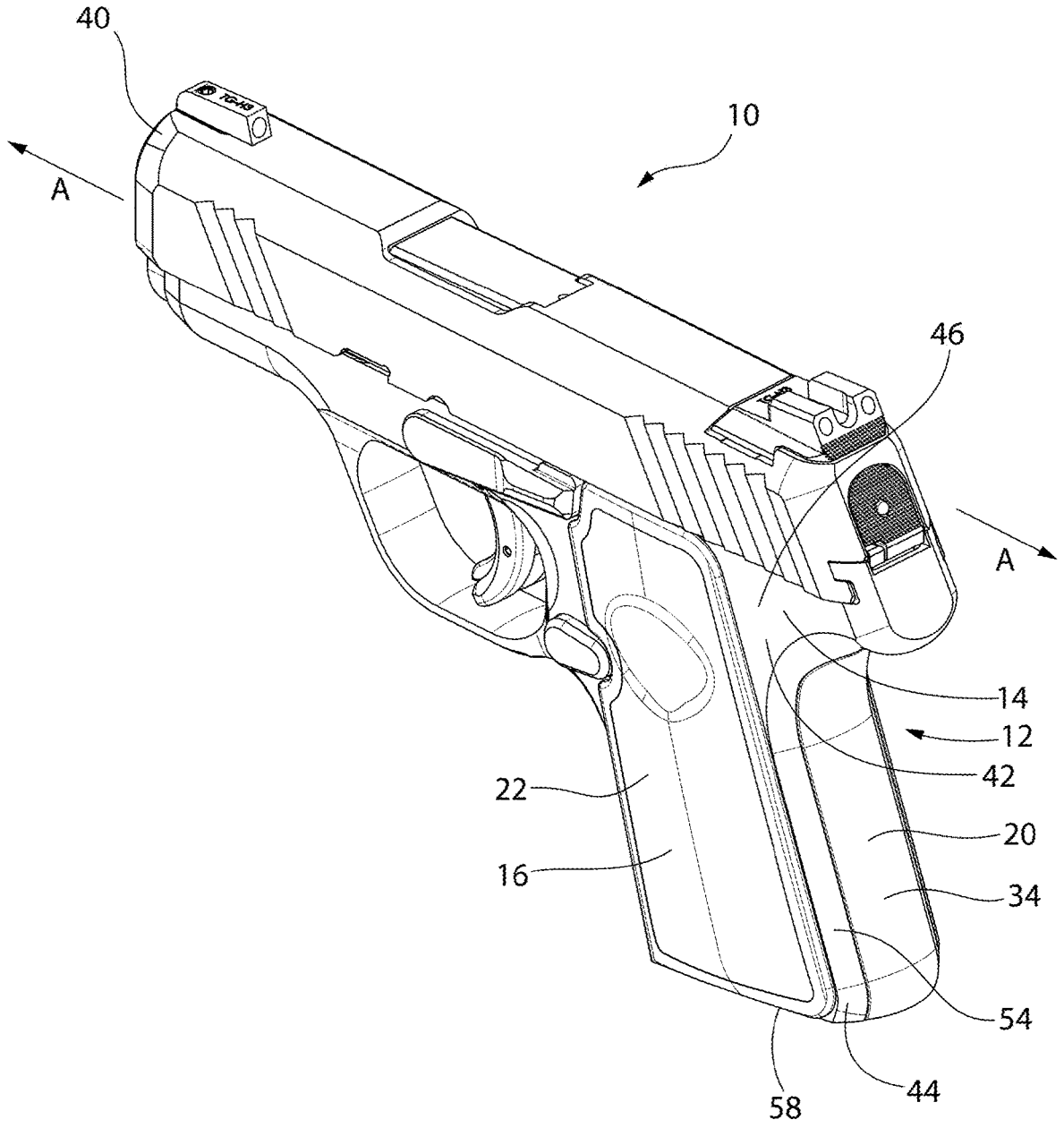
FIG. 1 is a rear isometric view of a firearm having a modular grip panel system in accordance with an exemplary embodiment of the present invention.
Figure 2:
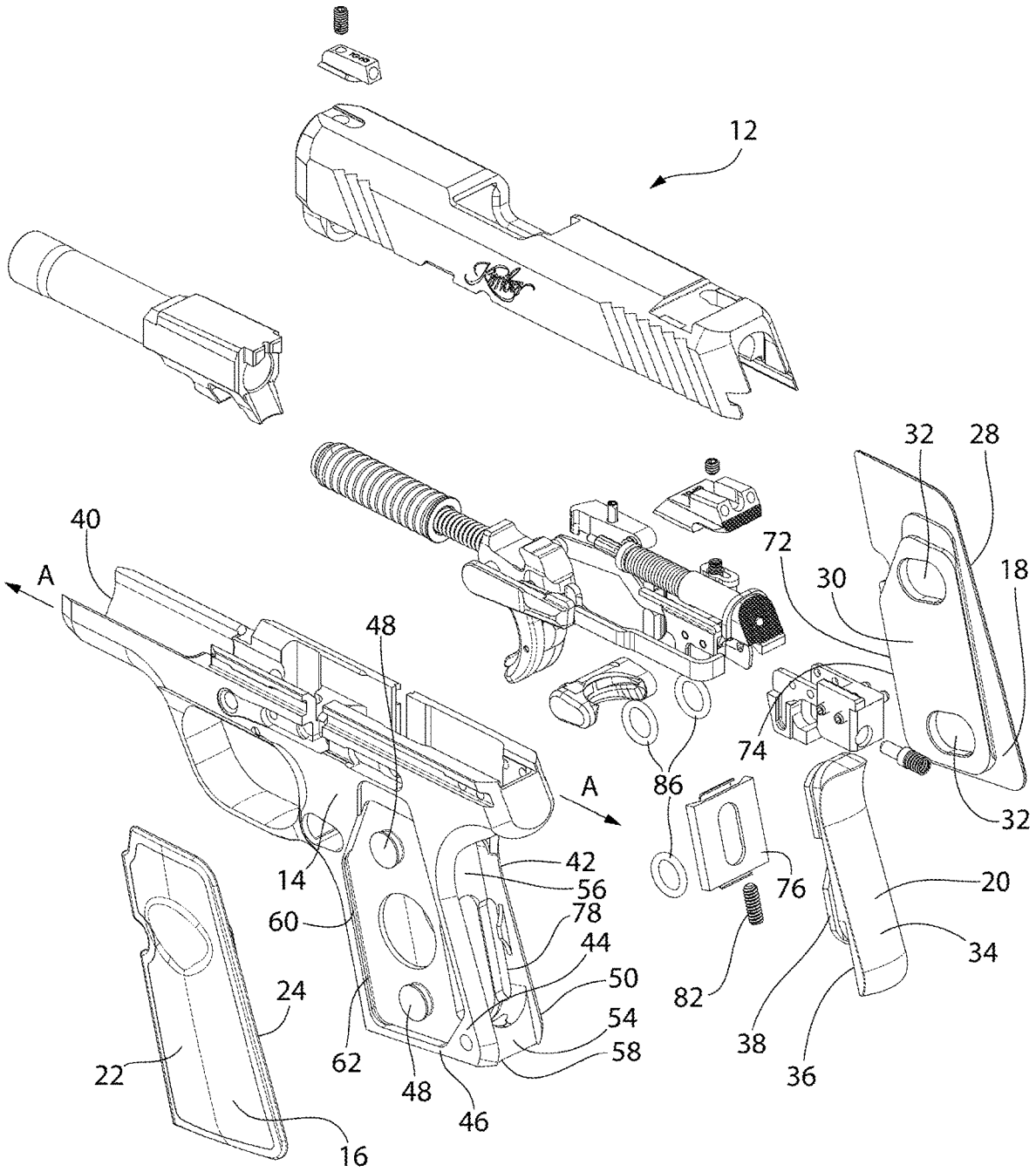
FIG. 2 is an exploded, rear isometric view of the firearm having the modular grip panel system of FIG. 1.
Figure 3:
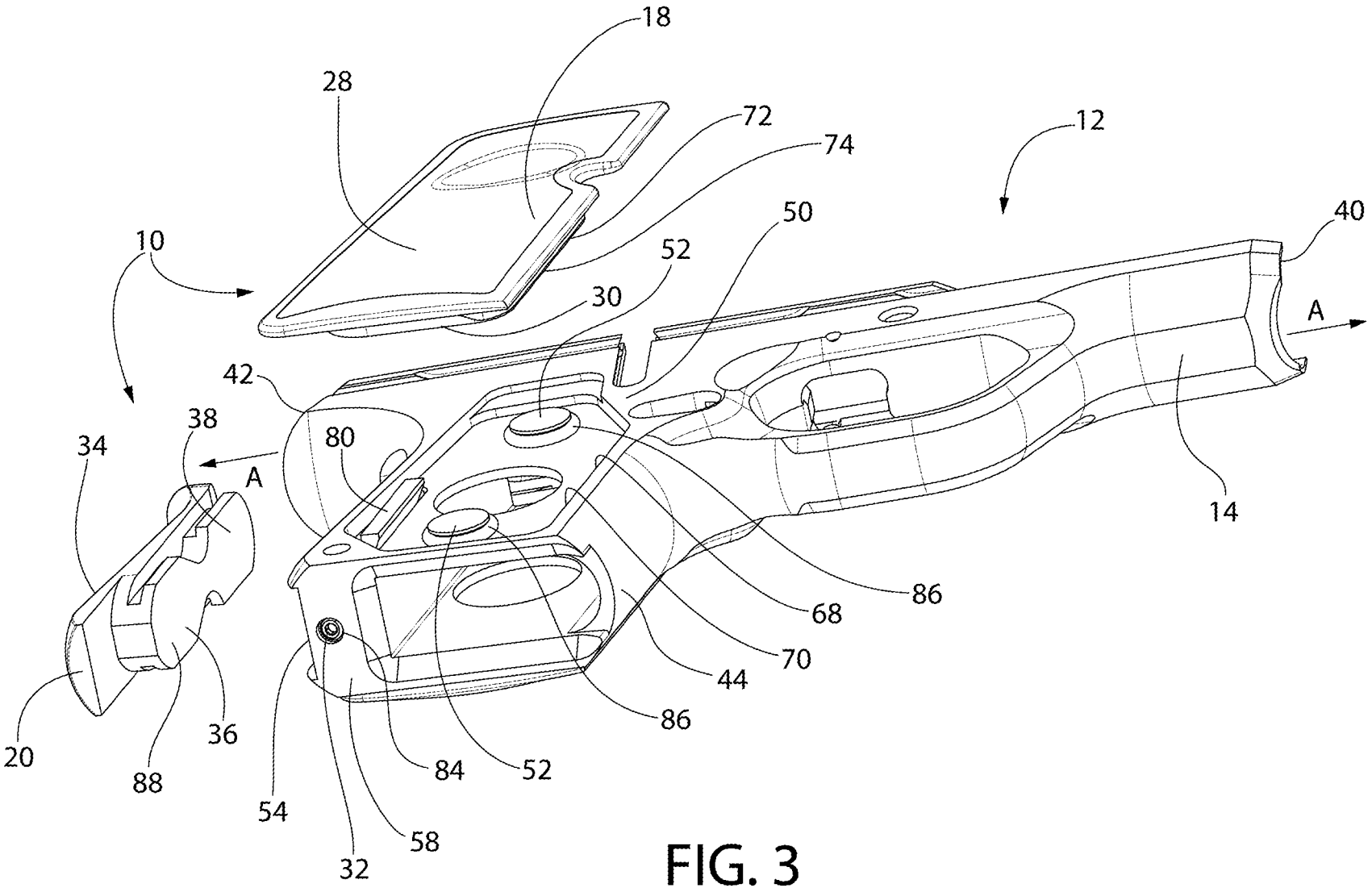
FIG. 3 is an exploded, bottom isometric view of a frame, a right grip panel and a backstrap for the firearm having the modular grip panel system of FIG. 1.
Figure 4:
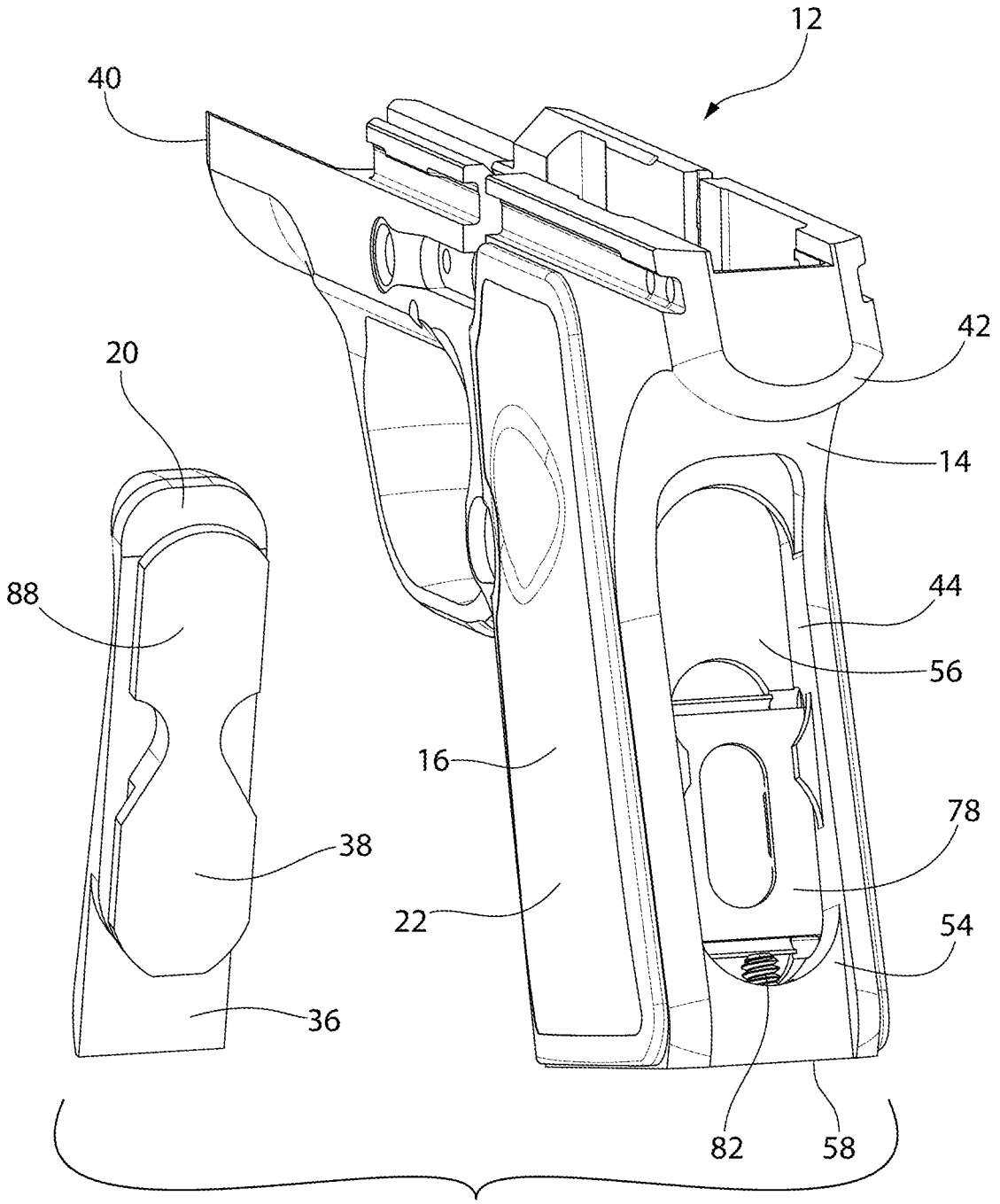
FIG. 4 is rear isometric view of a frame, left grip panel, backstrap (shown removed) and assorted other elements for the firearm having the modular grip panel system of FIG. 1.
Figure 5:
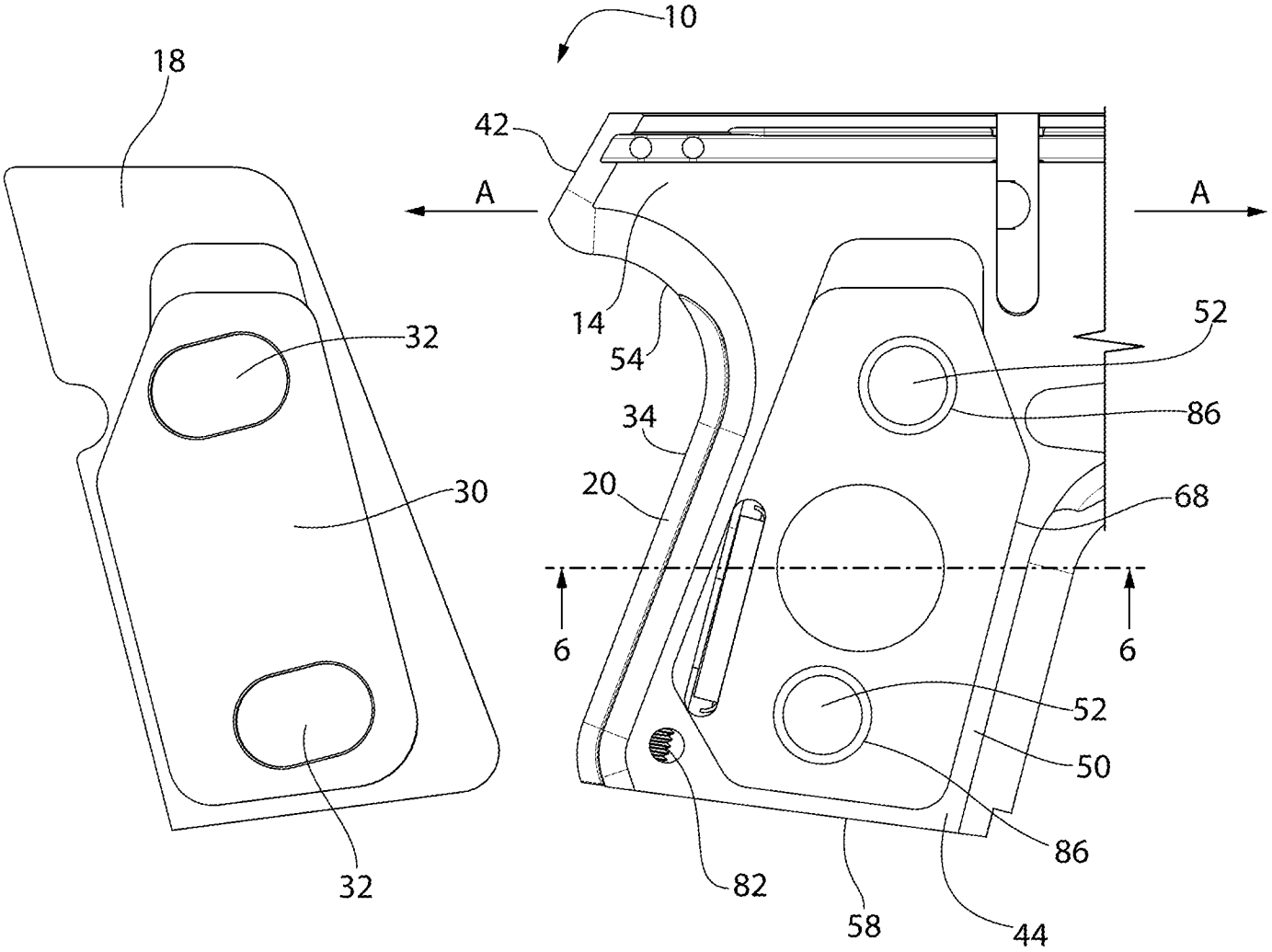
Figure 6:
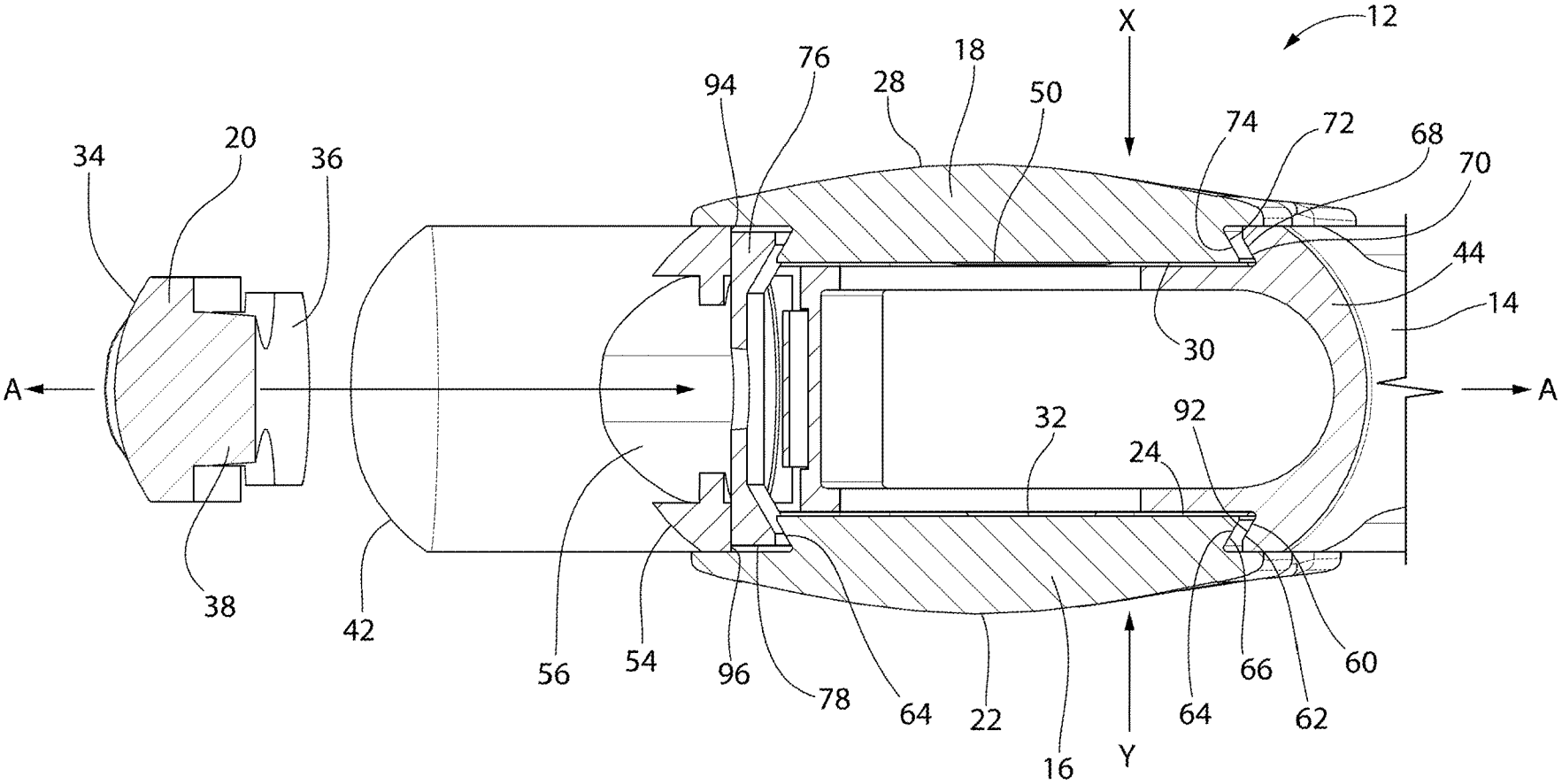
Figure 7:
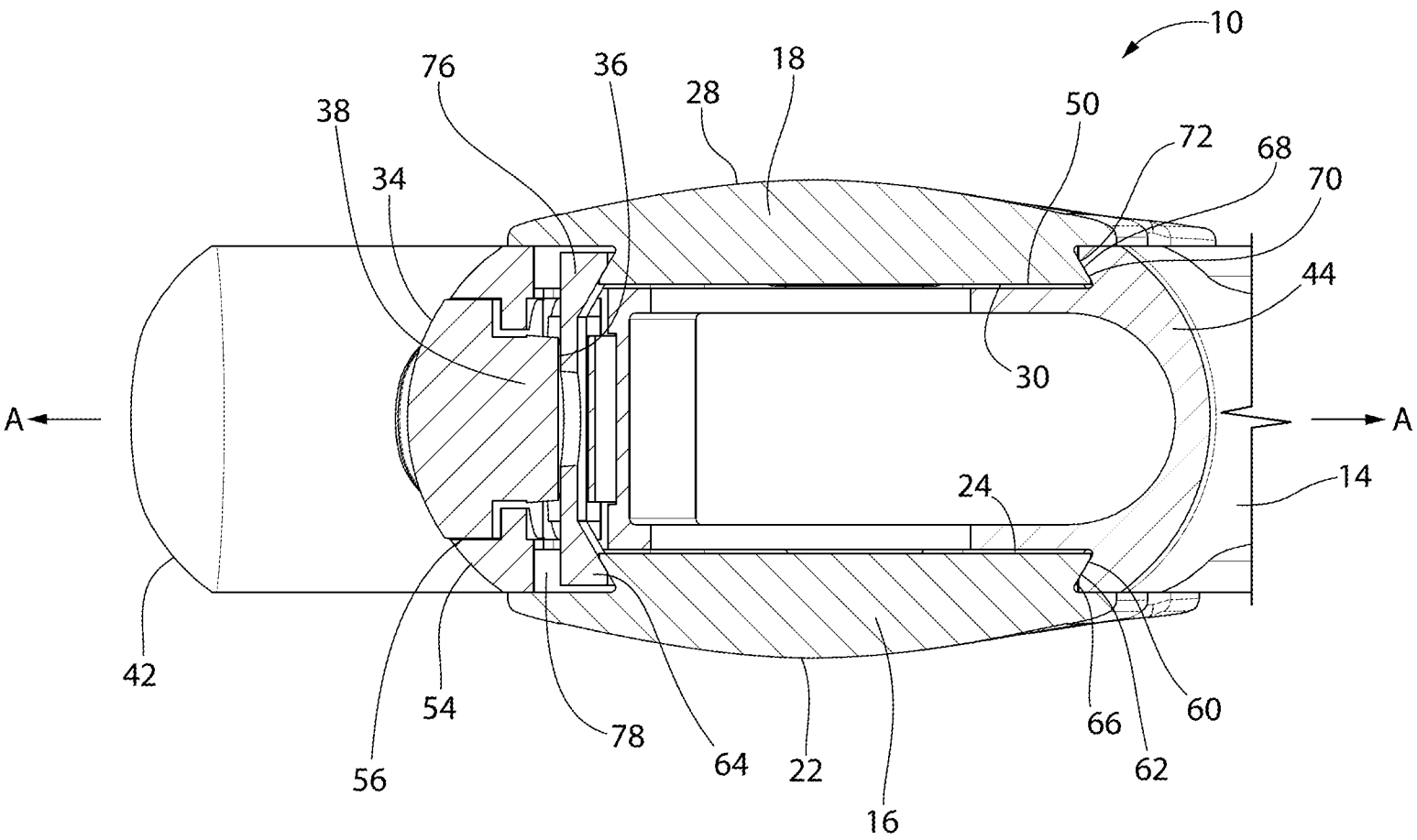

FIG, 5 is side elevation view of a frame, right grip panel and assorted other elements for the firearm having the modular grip panel system of FIG. 1;

FIG. 6 is cross-sectional view of a frame, backstop, right grip panel, left grip panel and assorted other elements for the firearm having the modular grip panel system of FIG. 1, taken substantially along lines 6-6 of FIG. 5, shown prior to assembly of the backstrap to the frame, wherein the right grip panel and the left grip panel are in a removable position; and FIG. 7 is the cross-sectional view of a frame, backstrap, right grip panel, left grip panel and assorted other elements for the firearm having the modular grip panel system of FIG. 6, shown in a fully secured position, wherein the right grip panel and the left grip panel and the backstrap are in a fixed in place.

DETAILED DESCRIPTION OF THE INVENTION

Referring now to the drawing figures, wherein like part numbers refer to like elements throughout the several views, there is shown in FIGS. 1-5 a modular grip panel system 10 for a firearm 12 in accordance with an exemplary embodiment of the present invention. The firearm 12 has a frame 14 to support a pair of grip panels 16, 18, and a grip backstrap 20.

As seen in FIGS. 2-7, the system 10 includes the right grip panel 18 having an outer surface 28 and an inner surface 30. The inner surface 30 has right side pockets 32. The left grip panel 16 also has an outer surface 22 and an inner surface 24 where, again, the inner surface 24 has a left side pocket (not shown, but a mirror image of the right side pockets 32). The system 10 also includes the backstrap 20 which has an outer surface 34 and an inner surface 36. The inner surface 34 has a backstrap boss 38.

The frame 14 of the firearm 12 has a barrel end 40 and a rear end 42. A pistol-style grip 44 is disposed at the rear end 42. The pistol-style grip 44 farther includes a left side surface 46 having left side bosses to engage the pockets of the left grip panel 16. A right side surface 50 is generally a mirror image of the left side surface 46 and has right side bosses 52 to engage the pockets 32 of the right grip panel 18. The frame 14 further has rear surface 54 that has a rear surface pocket 56 to receive the backstrap boss 38. Finally, the frame 14 has a bottom surface 58.

The left grip panel 16 is disposed on the left side surface 46 of the pistol-style grip 44 of the frame 14 by insertion of the left side bosses 48 of the frame 14 into the left side pockets (not shown) of the left grip panel 16. The left grip panel 16 is capable of limited movement in a single degree of freedom generally along an axis A from the barrel end 40 to the rear end 42 of the frame 14. The right grip panel 18 is disposed on the right side surface 50 of pistol-style grip 44 of the frame 14 by insertion of the right side bosses 52 into the right side pockets 32. The right grip panel 18 is capable of limited movement in a single degree of freedom generally along the axis A from the barrel end 40 and the rear end 42 of the frame 14. The backstrap 20 is disposed on the rear surface 54 of the pistol-style grip 44 of the frame 14 by insertion of the backstrap boss 38 into the rear surface pocket 56.

As best seen in FIG. 6, prior to the securement of the backstrap 20 to the frame 14, the left grip panel 16 and the right grip panel 18 are in rearwardmost positions in the frame 14 along axis A so that the left grip panel 16 and the right grip panel 18 can he moved into position in directions perpendicular to the frame (Direction X for the right grip panel 18 and Direction Y for the left grip 16 panel in FIG. 6) to install the grip panels 16, 18 to the frame 14. Note that gaps 90, 92 and 94, 96 provide adequate clearance for this movement (vertical in FIG. 6) and note that the left grip panel 16 and the right grip panel 18 are in their rearwardmost positons relative to the frame 14.

As best seen in FIG. 7, subsequent to securement of the backstrap 20 to the frame 14 when the backstrap 20 is secured to the frame 14, the left grip panel 16 is held in a forwardmost position in the frame 14 along axis A to secure the left grip panel 16 to the frame 14, and the right grip panel 18 is held in a forwardmost position along axis A to secure the right grip panel 18 to the frame 14. When secured to the frame 14, the backstop 20 (directly or indirectly) prevents movement of the left and right grip panels 16, 18 towards the rear end 42 of the frame 14 along axis A.

A front edge 60 of the left side pocket of the frame 14 may include a dovetail feature 62 to mate with a dovetail feature 64 adjacent a front edge 66 on the inner surface 24 of the left grip panel 16, wherein, when the left grip panel 16 is in the forwardmost position (see FIG. 7), the dovetail features 64, 66 mate to secure the left grip panel 16 to the frame 14. A front edge 68 of the right side pocket 32 of the frame 14 includes a dovetail feature 70 to mate with a dovetail feature 72 adjacent a front edge 74 on the inner surface 30 of the right grip panel 18, wherein when the right grip panel 18 is in the forwardmost position (see FIG. 7), the dovetail features 70, 72 mate to secure the left grip panel 16 to the frame 14.

A rear dovetail mortise member 76 may be disposed in a slot 78 adjacent to the rear pocket 56 of the frame 14 wherein the mortise member 76 is capable of movement in the slot 78 in a single degree of freedom generally along the axis A from the barrel end 40 and the rear end 42 of the frame. As can be seen in FIG. 6, prior to assembly, when the mortise member 76 is disposed in a rearwardmost position in the slot 78, the dovetail feature 64 of the left grip panel 16 is not mated with the dovetail feature 62 of the left side pocket 26. As can be seen in FIG. 7, when the mortise member 76 is disposed in a forwardmost position in the slot 78, the dovetail feature 64 of the left grip panel 16 mates with the dovetail feature 62 of the left side pocket 26 to secure the left grip panel 16 to the frame 14. Similarly, as can be seen in FIG. 6, prior to assembly, when the mortise member 76 is disposed in a rearwardmost position in the slot 78, the dovetail feature 72 of the right grip panel 18 is not mated with the dovetail feature 70 of the right side pocket 32. As can be seen in FIG. 7, when the mortise member 76 is disposed in a forwardmost position in the slot 78, the dovetail feature 72 of the right grip panel 18 mates with the dovetail feature 70 of the right side pocket 32 to secure the right grip panel 18 to the frame 14.

The mortise member 76 may be biased toward the barrel end 40 of the frame 14, by, for example, a spring (not shown). The backstrap 20 may be secured in the frame 14 via a set screw 82 disposed in a threaded hole 84 in the bottom surface 58 of the frame 14 to pin the backstrap 20 to the frame 14.

Finally, the right side bosses 52 of the frame 14 and the left side bosses 48 of the frame 14 each may have an O-ring 86 disposed thereon to minimize movement of the right grip panel 18 and the left grip panel 16 relative to the frame 14.

In summary, torward movement along axis A of the left grip panel 16 and the right grip panel 18 creates a tight dovetail fit and rearward movement along axis A creates a loose fit, allowing the panels 16, 18 to be released or installed. Enough rearward motion is possible to release left and right grip panels 16, 18 when the backstrap 20 is removed. When the backstrap 20 is installed, it applies forward pressure to ensure grip panel retention and a tight fit with frame 14. As the dovetail engagement tightens, the grip panels 14, 16 are pulled closer to frame 14 ensuring any gaps are closed between grip panels 16, 18 and frame 14.

The bosses 48, 52 and pockets 32 features provide for vertical alignment of the grip panels 16, 18. As discussed, the bosses 48, 52 may include O-rings 86 that fill gap between features. The O-rings 86 provide retention of grip panels during installation, eliminate movement or 'rattle' in the vertical direction, and reduced felt shock from recoil.

The backstrap 20 may lock into the frame 14 with a double key-hole feature 88. The key-hole feature 88 prevents movement of backstrap 20 in all but one degree of freedom. This 6th degree of freedom is used for installation and removal of backstrap 20. Because only one degree of freedom exists for backstrap 20, a single, hidden hardware feature (e.g., the set screw 82) can be used to secure the entire assembly.

The present design allows for maintaining aesthetic cues of firearms having grips without the need for external hardware such as exposed screw heads. For firearms with black hardware in particular, externally visible hardware is often unsightly due to inadvertent finish removal due to use of metal tools used for assembly and disassembly. In addition, the present design provides for rapid modularity of firearm furniture. Users can adjust color, texture, and grip size easily and quickly, aiding in comfort, visual appeal, and accuracy. Backstraps 20 with larger or smaller palm swells, grips with varying degrees of texture aggressiveness, and cosmetic variations may be used.

The invention will be illustrated in more detail with reference to the following embodiments, but it should be understood that the present invention is not deemed to be limited thereto.

While the invention has been described in detail and with reference to specific embodiments thereof, it will be apparent to one skilled in the art that various changes and modifications can be made therein without departing from the spirit and scope thereof.

What is claimed is:

1. A firearm having a modular grip panel system, the firearm having a frame to support a pair of grip panels and a grip backstrap, the firearm having a modular grip panel system comprising:

(a) a left grip panel having an outer surface and an inner surface, the inner surface having a left side pocket;

(b) a right grip panel having an outer surface and an inner surface, the inner surface having a right side pocket;

(c) a backstrap having an outer surface and an inner surface, the inner surface having a backstrap boss;

(d) the frame having a barrel end and a rear end and a pistol-style grip disposed at the rear end, the pistol-style grip further comprising:

(i) a left side surface having at least one left side boss to engage the pocket of the left grip panel;

(ii) a right side surface generally being a mirror image of the left side surface and having at least one right side boss to engage the pocket of the right grip panel;

(iii) a rear surface having a rear surface pocket to receive the backstrap boss; and (iv) a bottom surface;

(e) the left grip panel disposed on the left side surface of the pistol-style grip of the frame by insertion of the at least one left side boss into the left side pocket, the left grip panel capable of limited movement in a single degree of freedom along an axis from the barrel end and the rear end of the frame;

(f) the right grip panel, disposed on the right side surface of pistol-style grip of the frame by insertion of the at least one right side boss into the right side pocket, the right grip panel capable of limited movement in a single degree of freedom along the axis from the barrel end and the rear end of the frame; and (g) the backstrap disposed on the rear surface of the pistol-style grip of the frame by insertion of the backstrap boss into the rear surface pocket;

wherein, when the backstrap is secured to the frame, the left grip panel is held in a forwardmost position to secure the left grip panel to the frame, and the right grip panel is held in a forwardmost position to secure the right grip panel to the frame, wherein the backstrap prevents movement of the left and right grip panels towards the rear end of the frame.

2. The firearm having a modular grip panel system of claim 1, wherein a front edge of the left side pocket of the frame includes a dovetail feature to mate with a dovetail feature adjacent a front edge on the inner surface of the left grip panel, wherein when the left grip panel is in the forwardmost position, the dovetail features mate to secure the left grip panel to the frame, and wherein a front edge of the right side pocket of the frame includes a dovetail feature to mate with a dovetail feature adjacent a front edge on the inner surface of the right grip panel, wherein when the right grip panel is in the forwardmost position, the dovetail features mate to secure the left grip panel to the frame.

3. The firearm having a modular grip panel system of claim 2, including a rear dovetail mortise member disposed in a slot adjacent to the rear pocket of the frame, said mortise member capable of movement in the slot in a single degree of freedom along an axis generally from the barrel end and the rear end of the frame, wherein when the mortise member is disposed in a forwardmost position in the slot, the dovetail feature of the left grip panel mates with the dovetail feature of the left side pocket to secure the left grip panel to the frame, and the dovetail feature of the right grip panel mates with the dovetail feature in the right side pocket to secure the right grip panel to the frame.

4. The firearm having a modular grip panel system of claim 1, wherein the backstrap is secured in the frame via a set screw disposed in a threaded hole in the bottom surface of the frame to pin the backstrap to the frame.

5. The firearm having a modular grip panel system of claim 3, wherein the mortise member is biased toward the barrel end of the frame.

6. The firearm having a modular grip panel system of claim 5, wherein the mortise member is biased by a spring.

7. The firearm having a modular grip panel system of claim 1, wherein the at least one right side boss of the frame and the at least one left side boss of the frame each have an O-ring disposed thereon to minimize movement of the right grip panel and the left grip panel relative to the frame.

8. The firearm having a modular grip panel system of claim 1, wherein the backstrap locks into the frame with a double key-hole feature to prevent movement of backstrap relative to the frame to a single degree of freedom for installation and removal of the backstrap.

* * * * *